US006397830B1

(12) United States Patent
Dohta

(10) Patent No.: US 6,397,830 B1
(45) Date of Patent: Jun. 4, 2002

(54) AIR-FUEL RATIO CONTROL SYSTEM AND METHOD USING CONTROL MODEL OF ENGINE

(75) Inventor: Hisayo Dohta, Chiryu (JP)

(73) Assignee: Denso Corporation, Kariya (JP)

( * ) Notice: Subject to any disclaimer, the term of this patent is extended or adjusted under 35 U.S.C. 154(b) by 117 days.

(21) Appl. No.: 09/645,493

(22) Filed: Aug. 25, 2000

(30) Foreign Application Priority Data

Sep. 27, 1999 (JP) ..... 11-271576

(51) Int. Cl.[7] ..... F02D 41/18; F02D 41/30

(52) U.S. Cl. ..... 123/684; 123/674; 701/103; 701/104; 701/109

(58) Field of Search ..... 123/674, 684; 701/103, 104, 109

(56) References Cited

U.S. PATENT DOCUMENTS 5,445,136 A 8/1995 Yamashita et al.
5,479,897 A 1/1996 Kawai et al.
5,548,514 A * 8/1996 Hasegawa et al. ..... 123/673
5,794,604 A * 8/1998 Suzuki et al. ..... 123/674
5,852,930 A * 12/1998 Yasui et al. ..... 123/674
5,924,281 A * 7/1999 Yasui et al. ..... 123/674
6,230,486 B1 * 5/2001 Yasui et al. ..... 123/674
6,314,952 B1 * 11/2001 Turnin et al. ..... 123/674

FOREIGN PATENT DOCUMENTS

JP 06-249033 9/1994
JP 07-49049 2/1995

* cited by examiner

*Primary Examiner*—Erick Solis
(74) *Attorney, Agent, or Firm*—Nixon & Vanderhye P.C.

(57) ABSTRACT

An internal combustion engine is simulated as a control model that covers from a fuel injection point to an air-fuel ratio detection point. A response time constant of the control model is calculated as a continuous function of the amount of intake air, and a control gain of the control model is calculated as a continuous function of the response time constant. Control parameters of the control model are calculated using a calculation interval, the response time constant, an attenuation coefficient and the control gain. Thus, the control parameters are varied continuously in response to changes in the intake air amount. The air-fuel correction coefficient is calculated using the control parameters a0, a1, a2, b1 and b2 as well as a deviation of an actual air-fuel ratio from a target air-fuel ratio. The amount of fuel supplied to the engine is calculated using the air-fuel ratio correction coefficient.

5 Claims, 5 Drawing Sheets

AIR-FUEL RATIO CONTROL SYSTEM AND METHOD USING CONTROL MODEL OF ENGINE

CROSS REFERENCE TO RELATED APPLICATION

The present application relates to and incorporates herein by reference Japanese Patent Application No. 11-271576 filed on Sep. 27, 1999.

BACKGROUND OF THE INVENTION

The present invention relates to an air-fuel ratio control system and method for controlling fuel injection amount using a control model of an internal combustion engine that simulates a control object between a fuel injection point and an air-fuel ratio detection point of the engine.

Internal combustion engines of vehicles are controlled in a closed-loop or feedback manner with respect to air-fuel mixture supply. Specifically, the engine has a three-way catalyst at its exhaust side, and an air-fuel ratio sensor is provided upstream the catalyst. The air-fuel ratio of mixture, that is, the amount of fuel, supplied to the engine at the engine intake side is controlled to a target air-fuel ratio such as the stoichiometric ratio in response to air-fuel ratio detection outputs of the sensor.

In U.S. Pat. No. 5,445,136, it is proposed to simulate as a control object the engine covering from the fuel injection point to the air-fuel ratio detection point, and determines a calculation equation for calculating an air-fuel ratio correction coefficient from the simulated model. The air-fuel ratio correction coefficient is repetitively updated by substituting into the equation a deviation of the detected air-fuel ratio from the target air-fuel ratio and air-fuel ratio correction coefficients used previously. The fuel injection amount is calculated by correcting basic fuel injection amount with the updated air-fuel ratio correction amount.

The response time constant or delay of the control model of the engine from the fuel injection point to the air-fuel ratio detection point varies with engine operation conditions, particularly the intake air amount of the engine. This is because the response characteristics of the air-fuel ratio sensor that greatly affects the response characteristics of the control model varies with the engine operation conditions, particularly the intake air amount. For instance, the response time constant of the air-fuel ratio sensor becomes larger and, as a result, the response time constant of the control model becomes larger as the intake air amount decreases.

The conventional control models have not been determined in view of changes in the response time constant resulting from changes in the engine operation conditions. The control gain therefore had to be set relatively small so that the engine may be operated with stableness over entire operation range. The small control gain lessens the response characteristics of the air-fuel ratio control relative to changes in the engine operation conditions, resulting in insufficient exhaust gas purification by the catalyst.

It may be possible to switch the control model from one to another of a plurality of control models each time the engine operation condition changes from one range to another. However, this model switching will tend to generate discontinuities between the control model characteristics, and hence the air-fuel ratio correction coefficients calculated based on the determined control model will largely change at the time of model switching. This large change also results in deviation of the actual air-fuel ratio from the target air-fuel ratio, causing insufficient exhaust gas purification in the catalyst.

SUMMARY OF THE INVENTION

It is therefore an object of the present invention to provide an air-fuel ratio control system and method capable of changing a control model of engine without using a plurality of control models. According to the present invention, an air-fuel ratio control system has a fuel injector for injecting fuel into an engine and an air-fuel ratio sensor for detecting an air-fuel ratio of air-fuel mixture supplied to the engine. The engine is simulated mathematically as a control model that covers from a fuel injection point to an air-fuel ratio detection point. A response time constant of the control model is calculated as a continuous function of a predetermined engine operation parameter variable with a flow of air-fuel mixture, and a control gain of the control model is calculated as a continuous function of the calculated response time constant. Control parameters are calculated from the calculated response time constant and the calculated control gain, and an air-fuel ratio correction coefficient is calculated using the calculated control parameters and a deviation of the detected air-fuel ratio from a target air-fuel ratio. A fuel injection amount is calculated based on engine operating conditions and the calculated air-fuel ratio correction coefficient.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
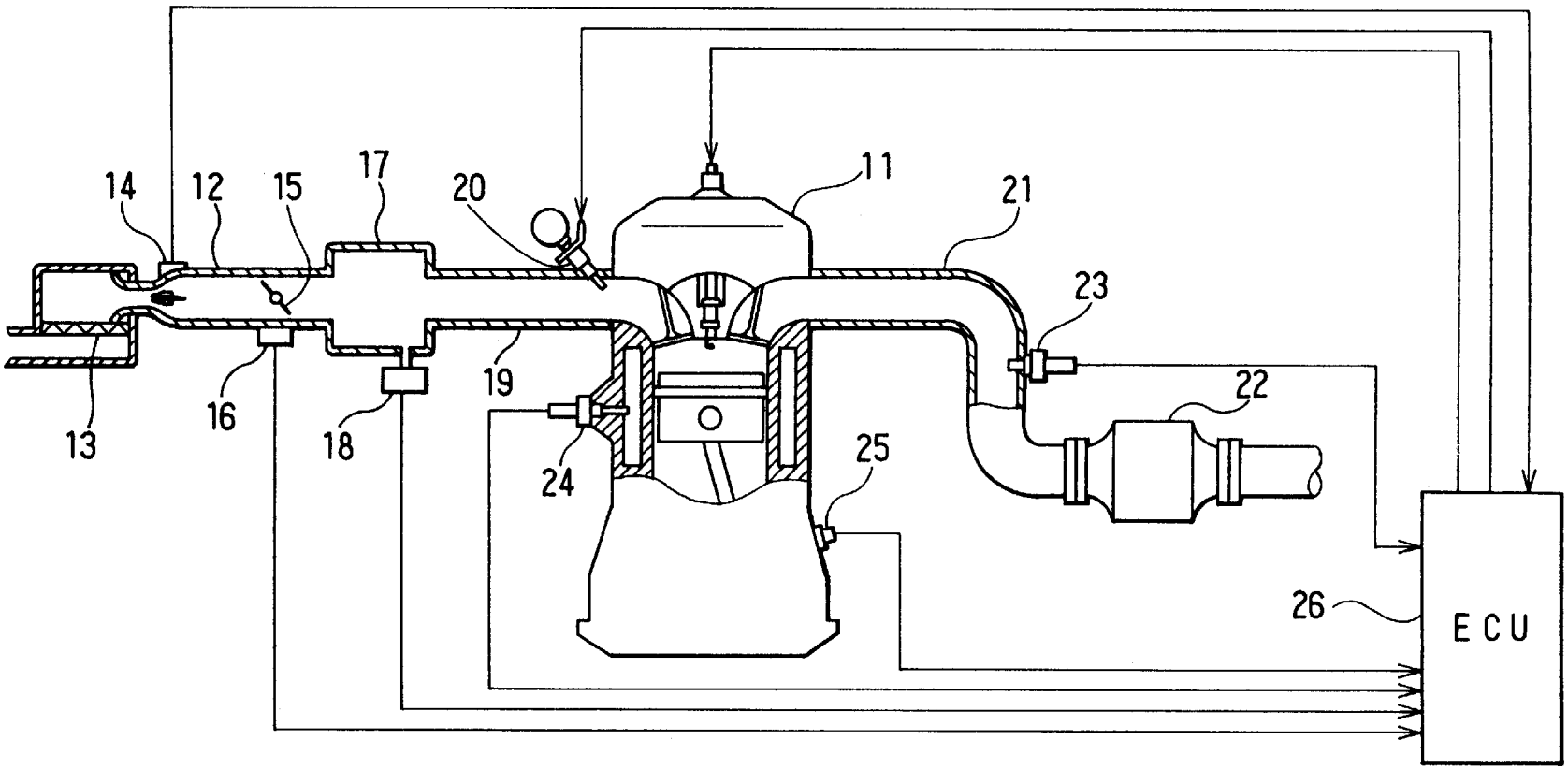
FIG. 1 is a schematic view showing an air-fuel ratio feedback control system according to an embodiment of the present invention.

Referring first to FIG. 1, an internal combustion engine 11 has an intake pipe 12 at an engine intake side. An air cleaner 13 is disposed at the most upstream side of the intake pipe 12, and an air flow sensor 14 is mounted downstream the air cleaner 13 for detecting the amount of intake air supplied to the engine 11. A throttle valve 15 and a throttle sensor 16 for detecting a throttle opening angle are disposed downstream the air flow sensor 14. The intake pipe 12 has a surge tank 17 to which a pressure sensor 18 is mounted for detecting the intake air pressure. Intake manifolds 19 are connected to the surge tank 17 for leading the intake air to respective cylinders of the engine 11. Fuel injectors 20 are mounted on the intake manifolds 19 to inject fuel into the intake manifolds 19, respectively.

The engine 11 has an exhaust pipe 21 at an engine exhaust side. A catalytic converter 22 including therein a three-way catalyst for purifying exhaust components (CO, HC, NOx, etc.) is disposed in the exhaust pipe 21. An air-fuel ratio sensor 23 is disposed upstream the catalytic converter 22 to detect richness/leanness of air-fuel mixture from the oxygen concentration in the exhaust gas. The air-fuel ratio sensor 23 may be an electromotive force voltage output type or a limit current output type both of which are well known in the art.

A coolant temperature sensor 24 for detecting an engine coolant temperature and a crank angle sensor 25 for detecting a crankshaft rotation are mounted on the engine 11. The above sensors 14, 16 18, 23, 24 and 25 are connected to an electronic control unit (ECU) 26. The ECU 26 is comprised of a microcomputer which is programmed to control the fuel injection amount and timing of the fuel injectors 20 based on engine operation conditions detected by the sensors. The engine operation, particularly air-fuel mixture combustion in the engine 11, is simulated mathematically as a control model of the engine.

Specifically, the microcomputer of the ECU 26 is programmed to feedback-control a fuel injection amount TAU based on an air-fuel ratio correction coefficient FAF calculated in response to the output of the air-fuel ratio sensor 23. The fuel injection amount TAU is calculated in such a manner that a basic fuel injection amount TP is calculated first from engine load parameters such as the intake air amount Qa sucked in each cylinder or pressure PM and the engine rotation speed, and then corrected with various other engine condition parameters such as the coolant temperature and the air-fuel ratio correction coefficient FAF.

Figure 2:
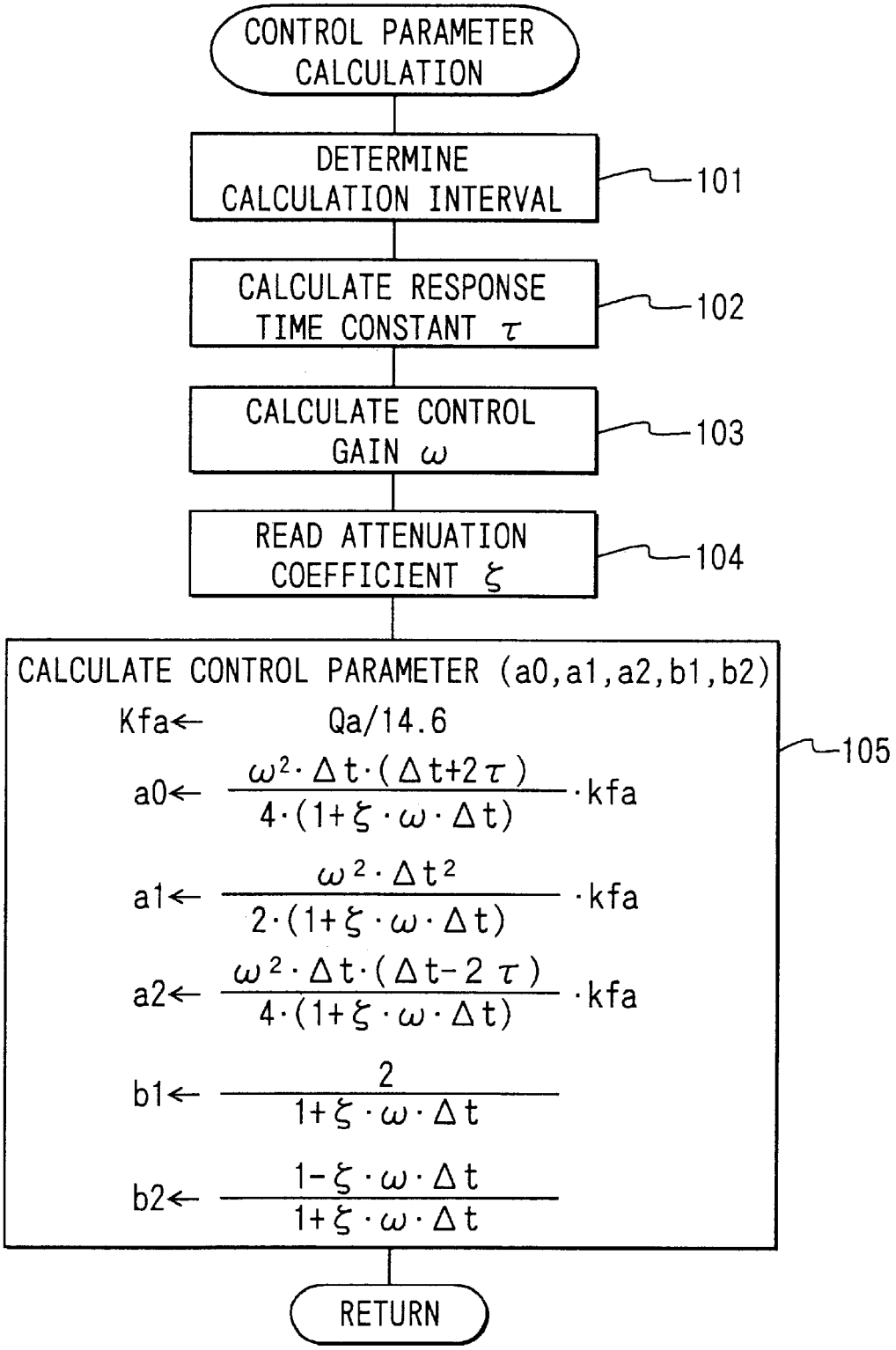
FIG. 2 is a flow diagram showing a control parameter calculation program executed in the embodiment.

In this embodiment, as shown in FIG. 2, the microcomputer calculates at every injection time control parameters for the control model of the engine simulated to cover from the fuel injector 20 to the air-fuel ratio sensor 23. It first determines at step 101 a calculation interval $\Delta t$ (injection interval) between two calculations (two injections), and then calculates a response time constant $\tau$ of the control model. This response time constant $\tau$ may be calculated from mapped data representing the characteristics of the response time constant $\tau$ relative to the intake air amount Qa per cylinder as shown in FIG. 5.

It is to be noted that the response time constant $\tau$ of the control model is affected by the response time constant of the air-fuel ratio sensor 23, the amount of injected fuel not sucked into the cylinder but adhering to the inside wall of the intake port and the like. Particularly, it is affected most by the response time constant $\tau$ of the sensor 23. As the response time constant of the sensor 23 changes with the intake air amount Qa (exhaust gas amount), the response time constant $\tau$ also changes greatly with the same.

Figure 5:
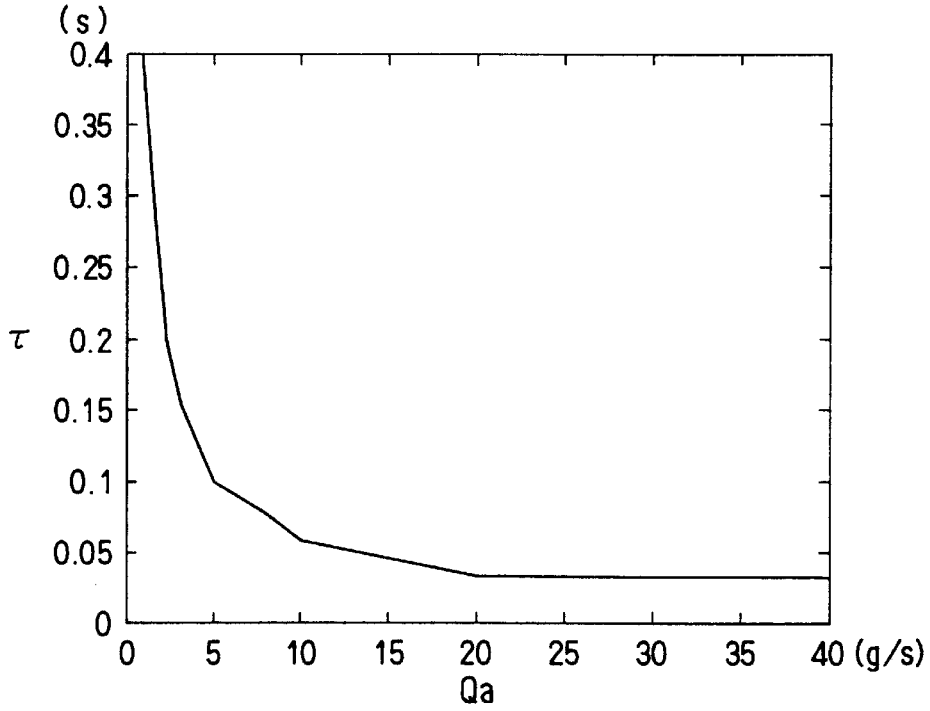
FIG. 5 is a graph showing a relationship between an intake air amount and a response time constant.

By determining the response time constant $\tau$ experimentally or through simulation as a continuous function of the intake air amount Qa as shown in FIG. 5 and storing it in a memory of the ECU 26, the response time constant $\tau$ can be determined to change continuously relative to the intake air amount Qa. Further, the response time constant $\tau$ is set to increase greatly as the intake air amount decreases.

Figure 6:
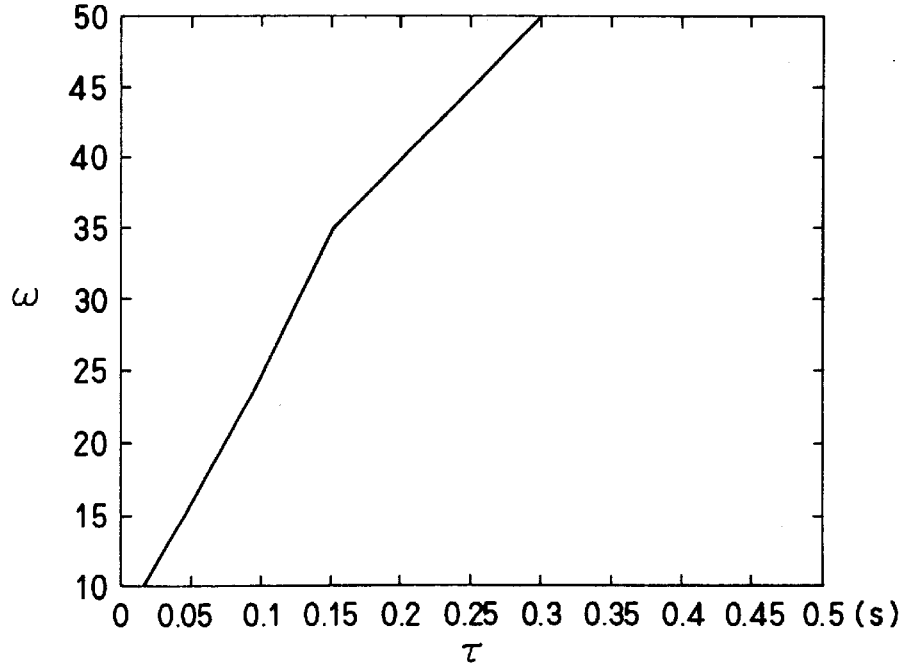
FIG. 6 is a graph showing a relationship between the response time constant and a control gain.

The microcomputer calculates a feedback control gain $\omega$ at step 103. The control gain $\omega$ may also be calculated from mapped data shown in FIG. 6 through experiments or simulation. The control gain $\omega$ is continuously increased to thereby increase control speed as the response time constant $\tau$ increases.

The microcomputer then reads out at step 104 an attenuation coefficient $\zeta$ that is pre-stored. This coefficient $\zeta$ is determined to be a value (for instance, 1.1) that is slightly larger than 1.0 to attain both control stability and response characteristics of control.

The microcomputer calculates at step 105 calculates control parameters a0, a1, a2, b1 and b2, using respective equations shown in FIG. 2. In each equation, the calculated interval $\Delta t$, response time constant $\tau$, control gain $\omega$ and attenuation coefficient $\zeta$. In this calculation, "kfa" corresponds to the amount of fuel calculated by dividing the intake amount Qa per cylinder by the stoichiometric air-fuel ratio (14.6). As the response time constant $\tau$ and the control gain $\omega$ is determined as continuously changing values, the control parameters a0, a1, a2, b1 and b2 also changes continuously.

Figure 3:
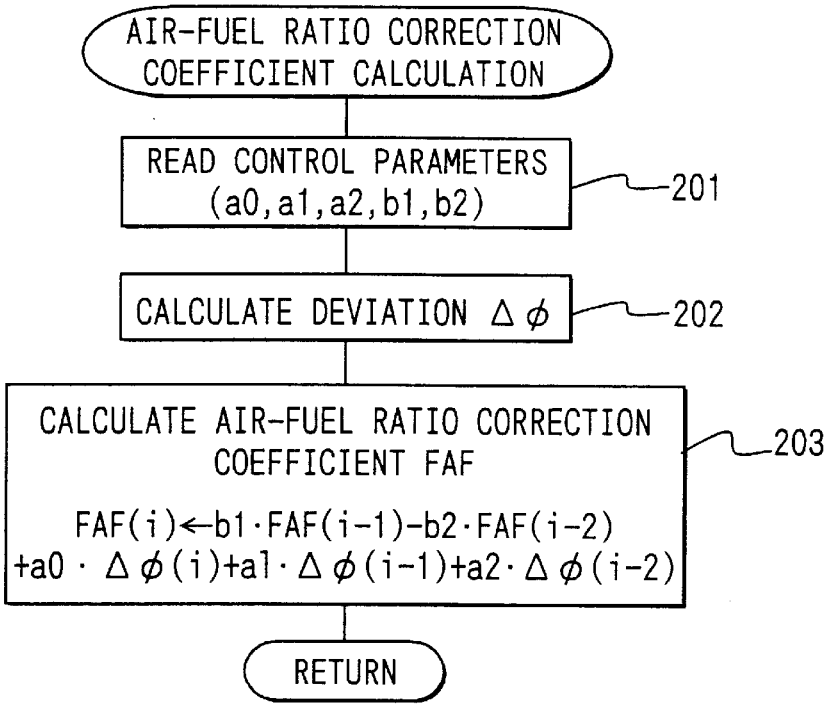
FIG. 3 is a flow diagram showing an air-fuel ratio correction coefficient calculation program executed in the embodiment.

After the control parameter calculation processing of FIG. 2, the microcomputer calculates an air-fuel ratio correction coefficient FAF as shown in FIG. 3. Specifically, the microcomputer reads out at step 201 the control parameters a0, a1, a2, b1 and b2 calculated as above and stored in the memory of the ECU 26. It then calculates at step 202 a deviation $\Delta\Phi(=\Phi T-\Phi D)$ of the actual fuel excess value $\Phi D$ determined from the output of the air-fuel ratio sensor 23 from the target fuel excess value $\Phi T$. The fuel excess value $\Phi$ is an inverse of the air excess value $\lambda$ of air-fuel mixture, that is, $\Phi=1/\lambda$. It further calculates at step 203 the air-fuel ratio correction coefficient FAF using the equation shown in FIG. 3. In this equation, (i) indicates a present calculation, (i-1) indicates a previous calculation and (i-2) indicates a calculation immediately before the previous calculation.

Figure 4:
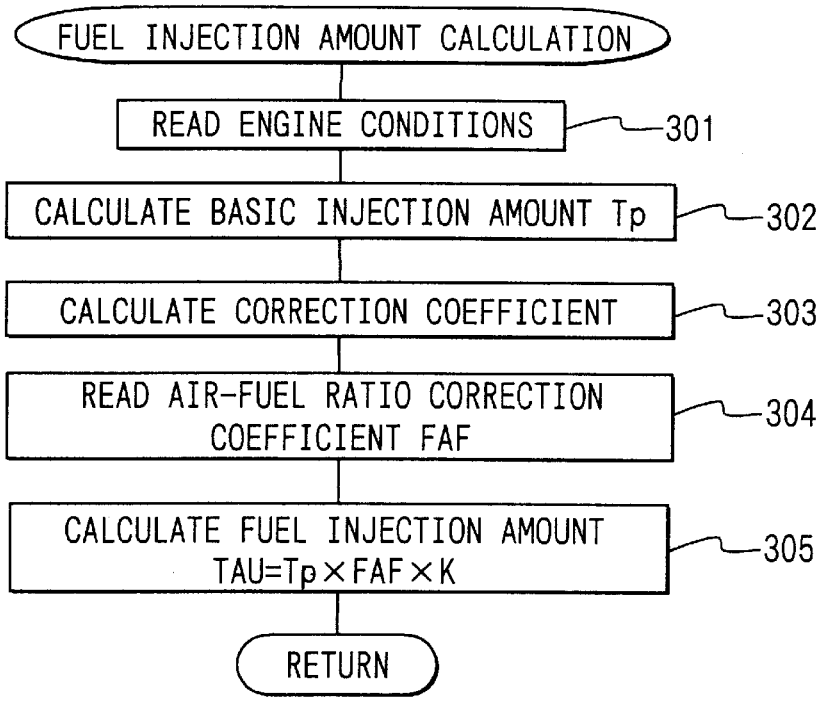
FIG. 4 is a flow diagram showing a fuel injection amount calculation program executed in the embodiment.

After the correction coefficient calculation processing of FIG. 3, the microcomputer calculates the fuel injection amount TAU as shown in FIG. 4. Specifically, the microcomputer reads out engine conditions such as the intake air amount and engine rotation speed at step 301, and calculates a basic fuel injection amount TP using those engine conditions. It then calculates at step 303 a correction value K from engine conditions such as coolant temperature and engine acceleration/deceleration condition. It reads out the calculated air-fuel ratio correction coefficient FAF, that is, FAF(i), and calculates finally the fuel injection amount TAU by multiplying the correction coefficients K and FAF to the basic injection amount TP.

Figure 7:
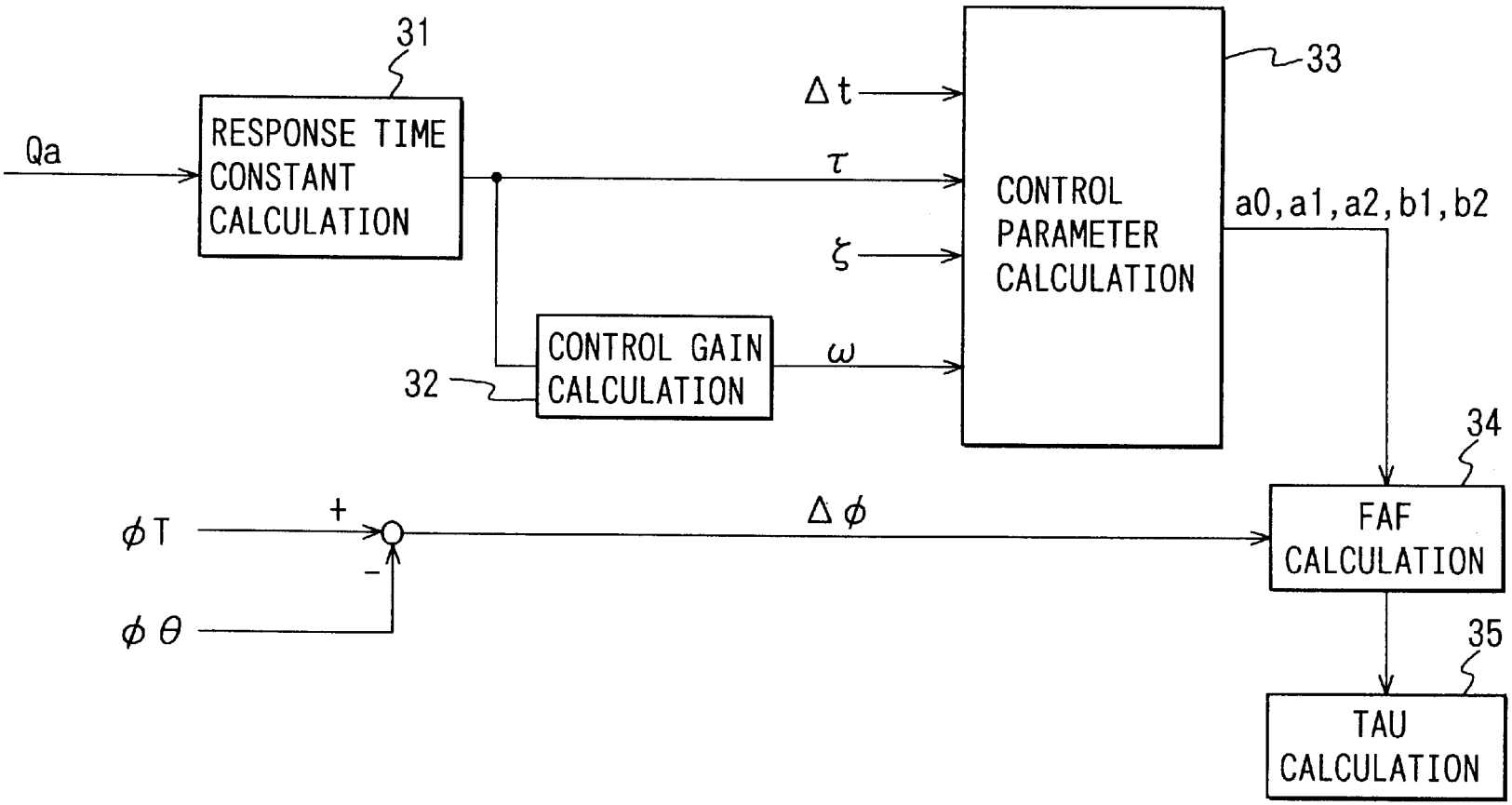
FIG. 7 is a block diagram showing a function of an electronic control unit in the embodiment.

The above control may be summarized as shown in FIG. 7. That is, the response time constant $\tau$ of the control model is calculated in a response time constant calculation unit 31 based on the Qa–$\tau$ characteristics shown in FIG. 5. The control gain $\omega$ of the control model is calculated in a control gain calculation unit 32 based on the $\tau$–$\omega$ characteristics shown in FIG. 6. The control parameters a0, al, a2, b1 and b2 of the control model are calculated in a control parameter calculation unit 33 using the calculation interval $\Delta t$, response time constant $\tau$, attenuation coefficient $\zeta$ and control gain $\omega$. Thus, the control parameters a0, al, a2, b1 and b2 are varied continuously in response to changes in the intake air amount Qa.

The present air-fuel correction coefficient FAF(i) is calculated in a FAF calculation unit 34 based on the control parameters a0, al, a2, b1 and b2 as well as the deviations $\Delta\Phi$(i), $\Delta\Phi$(i-1), $\Delta\Phi$n (i-2) and previous correction coefficients FAF(i-1), FAF(i-2). The fuel injection amount TAU is calculated in a TAU calculation unit 35 by correcting the basic fuel injection amount TP with the present air-fuel ratio correction coefficient FAF(i).

As described above, the response time constant $\tau$ of the control model is calculated as a continuous function of the intake air amount Qa, and the control gain $\omega$ is calculated as a continuous function of the response time constant $\tau$. That is, the characteristics of the control model is varied continuously with the engine operation conditions. As a result, the stability of operation of the engine can be enhanced over entire operation ranges, and the accuracy in the air-fuel ratio control can also be enhanced over the entire operation ranges. Further, the number of the control model of the engine stored in the memory of the ECU 26 can be limited to only one.

In the present embodiment, the response time constant $\tau$ of the control model may be calculated from other engine condition parameters such as the engine rotation speed and the intake air pressure. It may alternatively be determined or calculated from the intake air amount and the amount of fuel adhering to the inside wall of the intake port, because the response time constant $\tau$ also changes with the amount of fuel remaining on the intake port. The amount of fuel remaining on the intake port may be estimated from engine coolant temperature.

Still further, the air-fuel ratio correction coefficient FAF may be calculated from a deviation of the detected air excess value from the target air excess value, or from a deviation of the detected air-fuel ratio from the target air-fuel ratio. The control parameters a0, al, a2, b1 and b2 and/or the air-fuel ratio correction coefficient FAF may be calculated using different equations.

The present invention should not be limited to the above embodiment and modifications but may be implemented in many other ways without departing from the spirit of the invention.

What is claimed is:

1. An air-fuel ratio control system having a fuel injector for injecting fuel into an engine and an air-fuel ratio sensor for detecting an air-fuel ratio of air-fuel mixture supplied to the engine, so that the amount of fuel is controlled to a target air-fuel ratio in response to the detected air-fuel ratio using a control model that simulates the engine covering from a fuel injection point to an air-fuel ratio detection point, the system comprising:

response time constant calculation means for calculating a response time constant of the control model as a continuous function of an operation condition of the engine; and control gain calculation means for calculating a control gain of the control model as a continuous function of the calculated response time constant.

2. The system as in claim 1, wherein the calculated response time constant of the control model includes a response time constant of the air-fuel ratio sensor.

3. The system as in claim 1, wherein the response time constant is calculated as the continuous function of at least one of an intake air amount and both of a rotation speed and an intake pressure of the engine.

4. The system as in claim 1, further comprising:

control parameter calculation means for calculating a control parameter used in a calculation of an air-fuel ratio correction coefficient determined from the control model;

air-fuel ratio correction coefficient calculation means for calculating the air-fuel ratio correction coefficient using the calculated control parameter and a deviation of the detected actual air-fuel ratio from the target air-fuel ratio; and fuel injection amount calculation means for calculating the fuel injection amount by correcting, with the air-fuel ratio correction coefficient, a basic fuel injection amount calculated from engine operation conditions.

5. An air-fuel ratio control method for engines having a fuel injector for injecting fuel into an engine and an air-fuel ratio sensor for detecting an air-fuel ratio of air-fuel mixture supplied to the engine, the method comprising the steps of:

determining a control model which simulates the engine covering from a fuel injection point to an air-fuel ratio detection point, the control model being defined mathematically using control parameters;

calculating a response time constant of the control model as a continuous function of a predetermined engine operation parameter variable with a flow of air-fuel mixture;

calculating a control gain of the control model as a continuous function of the calculated response time constant;

calculating the control parameters from the calculated response time constant and the calculated control gain;

calculating an air-fuel ratio correction coefficient using the calculated control parameters and a deviation of the detected air-fuel ratio from a target air-fuel ratio; and calculating a fuel injection amount based on engine operating conditions and the calculated air-fuel ratio correction coefficient.

* * * * *